US007516749B2

(12) United States Patent
Felder et al.

(10) Patent No.: US 7,516,749 B2
(45) Date of Patent: Apr. 14, 2009

(54) METHODS OF AND APPARATUS FOR WASHING HIGH-DENSITY MICROPLATES

(75) Inventors: Stephen Felder, Tucson, AZ (US); Richard Kris, Tucson, AZ (US); Brian McGraw, Tucson, AZ (US)

(73) Assignee: Neogen, LLC, Tucson, AZ (US)

( * ) Notice: Subject to any disclaimer, the term of this patent is extended or adjusted under 35 U.S.C. 154(b) by 964 days.

(21) Appl. No.: 10/408,108

(22) Filed: Apr. 8, 2003

(65) Prior Publication Data

US 2004/0200509 A1 Oct. 14, 2004

(51) Int. Cl.
*B08B 6/00* (2006.01)

(52) U.S. Cl. ..... 134/198; 436/49; 436/43

(58) Field of Classification Search ..... 134/198, 134/43, 44, 50, 104.1, 104.2, 117, 172, 166 R; 239/596, 592, 589.1
See application file for complete search history.

(56) References Cited

U.S. PATENT DOCUMENTS

| | | | | | |
|---|---|---|---|---|---|
| 2,345,812 | A | * | 4/1944 | Harriman et al. | 239/391 |
| 3,069,094 | A | * | 12/1962 | Haloski et al. | 239/261 |
| 4,559,664 | A | * | 12/1985 | Bohme et al. | 15/302 |
| 4,635,665 | A | * | 1/1987 | Namba et al. | 134/167 R |
| 4,685,480 | A | | 8/1987 | Eck | |
| 5,078,164 | A | * | 1/1992 | Doellgast | 134/166 R |
| 5,186,760 | A | * | 2/1993 | Rubenzer | 134/22.18 |
| 5,335,682 | A | * | 8/1994 | Yoshimura et al. | 134/72 |
| 5,882,597 | A | * | 3/1999 | Astle | 422/65 |
| 5,951,783 | A | * | 9/1999 | Kontorovich et al. | 134/21 |
| 6,403,379 | B1 | * | 6/2002 | Munson et al. | 436/43 |
| 2002/0045270 | A1 | | 4/2002 | Schurenberg et al. | |
| 2003/0234303 | A1 | * | 12/2003 | Berning et al. | 239/589.1 |
| 2004/0058327 | A1 | * | 3/2004 | Pan et al. | 435/6 |
| 2004/0089330 | A1 | * | 5/2004 | Muller | 134/167 R |

FOREIGN PATENT DOCUMENTS

| | | | | |
|---|---|---|---|---|
| DE | 37 08 529 | A1 | | 9/1988 |
| DE | 3708529 | A1 | * | 9/1988 |
| FR | 2 112 856 | | | 6/1972 |
| FR | 2 193 337 | | | 2/1974 |
| FR | 2193337 | A | * | 3/1974 |
| FR | 2 481 150 | | | 10/1981 |
| FR | 2 639 263 | | | 5/1990 |
| FR | 2639263 | A1 | * | 5/1990 |
| WO | WO02070135 | A2 | * | 9/2002 |

* cited by examiner

*Primary Examiner*—Michael Barr
*Assistant Examiner*—Jason P Riggleman
(74) *Attorney, Agent, or Firm*—Millen White Zelano & Branigan, P.C.

(57) ABSTRACT

Methods of and apparatus for washing an array of sites in high-density microplates or similar assay plates wherein the microplates or assay plates are washed in an inverted or nearly inverted position, rather than in an upright position. Preferably, the wash liquid is dispensed upwardly in the form of a sheet from a nozzle mounted on a spray bar as the spray bar moves relative to the microplate or assay plate. After washing, the microplate or assay plate is dried with a stream of gas such as air, also preferably blown upwardly in the form of a sheet.

10 Claims, 12 Drawing Sheets

View A (2.5 : 1)

METHODS OF AND APPARATUS FOR WASHING HIGH-DENSITY MICROPLATES

This invention received U.S. government support under SBIR Phase I grant/DMI-0319656 with SBIR Phase II grant/DMI-0450448 awarded by NSF.

The present invention is directed to methods of and apparatus for washing the wells of high-density microplates or similar assay trays. High-density microplates are plates, or trays, used for running biological or biochemical tests, with many individually separate sites configured as wells per plate, each used for a separate test. The number of wells can be 96, 384, 864, 1536 or more; or the plates could have no physically separate wells, in which case the plates can be flat plates with discrete or indiscrete deposit sites with no wells at all. Typically in a biochemical assay, a reagent is allowed to bind to something on the surface of each site, and unbound material must be washed away so that the amount of material that remains is bound can be measured. The plate washers currently in use deliver rinse fluid to each well or deposit site of the microplate from above, through individual nozzles, and then aspirate the rinse fluid from each well or deposit cell with the same or similar nozzles.

In this invention, the microplate is washed in an inverted or nearly inverted position, rather than in an upright position. Importantly this position allows the wells to be rinsed continually with an amount of fluid that would overflow the wells and risk contamination of neighboring wells if the plates were upright. With the inverted position, the rinse fluid falls away from the plate rather than causing flooding to neighboring wells. Using this inverted plate, the wash fluid need not be added to wells or deposit sites individually; rather it can be sprayed by one or a few larger nozzles that are unlikely to clog (as opposed to using many individual slim needles). Moreover, to complete each wash cycle, the wash fluid delivered to the wells or deposit sites can be removed by air blown into the wells or by drawing air into and out of the wells or deposit sites by use of a vacuum source placed near the wells or deposit sites. Either way, the fluid can be removed with one or a few large nozzles that do not reach into the wells, rather than by use of many individual narrow tubes that need to reach inside each well. This apparatus provides a more reliable washer for high-density microplates than is currently available.

The washer of this invention is an improvement on existing washers and utilizes a novel concept in the washing process. The microplate is washed in a position in which it is not upright, does not use tubes for adding and removing liquid and is independent of the number or spacing of wells or deposit sites in a microplate. This invention can also be used for microplates that have a different dimension than conventional rectangular microplates by making minor hardware modifications.

The plate is essentially upside down when being washed, i.e., in substantially an inverted position, although other angles are possible.

The microplate can thus be washed using one flat, wide nozzle that delivers a thin sheet (or a knife edge) of fluid. The knife-edge for example can be swept over the length or width of-the plate, e.g., roughly 0.1 inch from the top surface of the plate, although other distances are possible depending on the nozzle used. Air (other gases or a vacuum) can be used to remove the liquid from the wells or deposit sites with the same or a similar nozzle. The nozzles are preferably separate but may be connected. There may be one opening in each nozzle or more than one opening. The pressure used to drive the liquid or air or vacuum may be the same or different, typically in the range of 15 to 60 psig. No tubes (or needle-shaped nozzles) are thus needed to deliver fluid to individual wells or deposit sites or to enter the wells of the plate for aspirating the fluid, so errors due to misalignment of the nozzle with individual wells or sites, especially for smaller well and deposit site diameters and spacings, are not an issue. Similarly, having one larger nozzle instead of many very thin needle-shaped nozzles reduces the chance of clogging and enables self-cleaning of the nozzles. Other benefits include speed and simplicity. Well or deposit site alignment is not as crucial for this washing system as it is when pins or needles are used to remove and/or add liquid to wells or sites.

This washer also uses the overflow principle of washing which makes it more efficient in the washing process. That is, rather than simply filling each well with fluid and removing the fluid in a cyclic fashion, the wash fluid is flowed continually through the wells with much more fluid than would fill each well. The excess fluid simply falls away from the plate into an enclosed chamber (tub) and is moved to a waste reservoir via an external tube. This makes washing very rapid and efficient.

Microplates useful in this invention are of all types. Microplates can have 96 wells or more per plate. Many now have 384, 864, 1536 wells and more per plate. The plates may be rectangular or may have other shapes, such as circular. Plates can have very small, shallow wells surrounded by a hydrophobic environment or have no physical separation at all between areas where separate analyses are run. Well and site diameters typically vary inversely with the number of wells, e.g., for 96 and 384 wells, are approximately 6.9 mm and 3.8 mm respectively. As the density of wells is increased to 1536 per plate, the well diameter (1.7 mm), although restricting the diameter of the prior art tubes that are used for dispensing into and removing fluid from the wells, is readily compatible with this invention. Well-to-well spacing is also much smaller for the higher density plates (e.g. 2.25 mm for Greiner 1536 well plates). Again, this is compatible with this invention, as are even smaller diameters and well-to-well spacings.

It is anticipated that microplates with more than 1536 wells will soon be commercially available. These will also be compatible for use with this invention. The same is true for 1536 well plates (Greiner) and others that might have square wells where liquid will not get trapped in the corners as in conventional washers. Other formats for microplates with very high densities of samples, such as tiny wells located on round disks similar to CD's, and microplates with no physical separation between samples, etc. are all applications suitable for this invention.

As can be seen, this invention relates to a washing apparatus and system that is independent of the number of wells or deposit sites per plate, and does not use the conventional needles or tubes that clog easily and are thus inefficient. Many variations for plate size and dimensions can be used, including high-density microplates that meet the standards adopted by the Society for Biomolecular Screening and others. The washer can be adapted for use in any format, including other microplate shapes and microplates without wells. The washer according to the present invention is compatible with nanoscale applications such as micro-electro-mechanical-systems (MEMS) by miniaturization of the washer.

Only routine considerations, with perhaps a few orientation tests, will be involved to optimize system parameters for any given plate configuration. The following discussion is not intended to be limiting. In preferred aspects, the force of the fluid system is routinely controlled so that it is not great enough to force the fluid that is flowing from one well up into an adjoining well. Preferably stream width is substantially smaller than the diameters of the wells. Typically, the ratio of stream width to diameter is significantly less than one. The ratio is dependent on the plate configuration and manufacturer. This is easily achieved. In one instance with 1536 well plates the ratio of stream width to diameter is approximately 1:5. Suitable fluid stream force is related to the total wash volume used to effectively wash a plate. It is optimum to keep this number to a minimum to maximize the number of plates which can be washed prior to refilling the system wash reservoir. The smaller the width of the stream, the higher the pressure needed to generate a force which will result in the fluid reaching the bottom of a well. The width of the fluid stream needs to be narrower than the well diameter. For example, the width of the fluid stream can be less than 1/10 the width of the 1536 well openings. For a constant stream width, increasing the pressure will increase the mass flow rate. These relationships are intertwined and routinely variable. The orientation of the fluid stream is substantially perpendicular to the plate, preferably perpendicular.

Unlike present washers that are typically configured for specific plate arrays or groups of arrays, the washer of this invention does not require major hardware changes to accommodate different plate arrays. Routinely varying the pressure and/or the speed across a plate will readily optimize performance where needed, advantageously without any necessity for changing nozzle configuration.

In a preferred embodiment, the wash head and the drying head each have only one opening in which liquid, air or vacuum flows. In other embodiments, more than one opening can be used. In all cases the nozzle opening(s) is independent of well configuration.

The washer of this invention can be used in manual form or routinely automated as is conventional, and unless indicated otherwise herein, is used under conditions and with design details which are routinely analogously determinable from prior art considerations as disclosed, e.g., in U.S. Pat. Nos. 4,685,480, 5,186,760, 4,015,942, 5,648,266, 4,493,896, and 5,882,597, among others. The washer can be used with a dispenser to add liquid to the wells after washing, or can be used alone. The washer can also be interfaced with robotic automated systems or stacking systems.

One version of the washer is shown in FIG. 1-6; FIG. 2 shows how the plate is inverted in the washer, and FIG. 6 shows how the wash and air manifolds move under the inverted plate. In these designs the microplate is in an exactly inverted position above the nozzles, with one nozzle delivering a thin knife-edge of wash fluid and another delivering a drying knife-edge of air directly or nearly directly upwards into the wells. A large collection tub captures the liquid used in the washing protocol.

Various features and attendant advantages of the present invention will be more fully appreciated as the same becomes better understood when considered in conjunction with the accompanying drawings, in which like reference characters designate the same or similar parts throughout the several views, and wherein:

The following drawings show how the washer can be made and how it can operate. These drawings are for illustrative purposes only and do not limit the scope of the invention.

Figure 1:
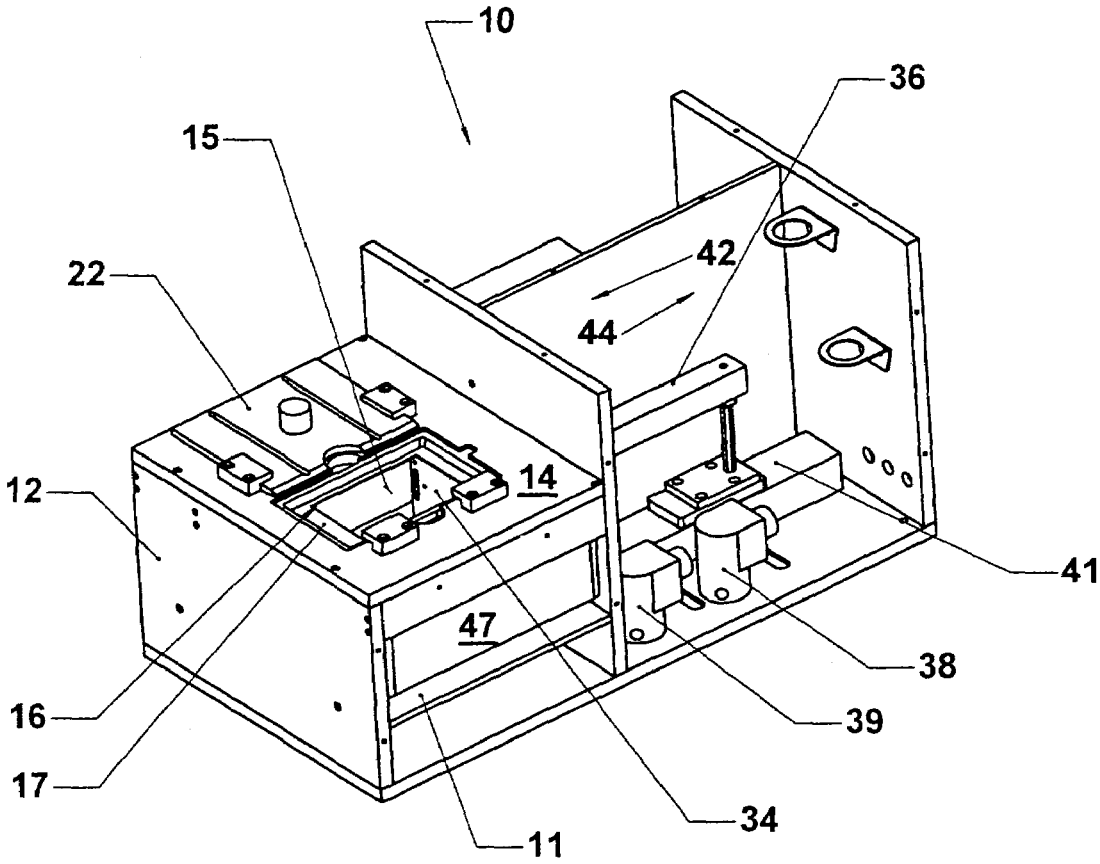
FIG. 1 is a perspective view of a portion the washer apparatus according to the invention, showing the apparatus prior to mounting an assay plate therein.
Figure 2:
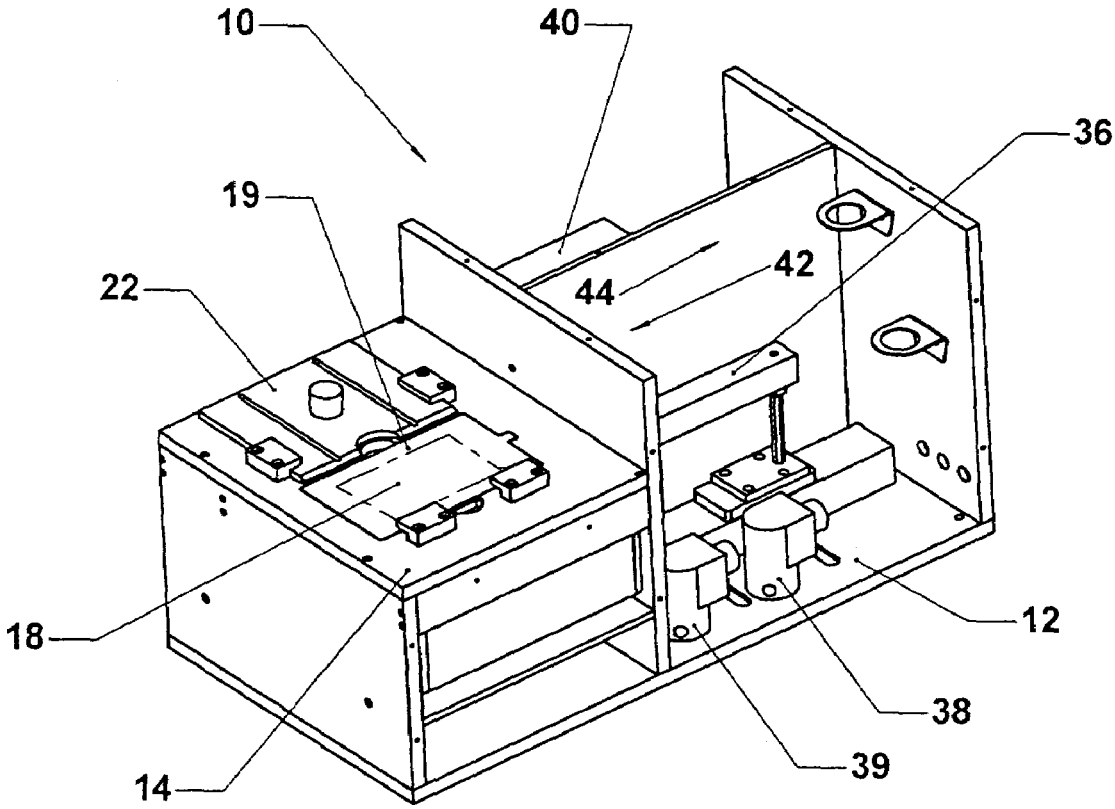
FIG. 2 is a view similar to FIG. 1 showing an assay plate mounted on the washer apparatus of FIG. 1.

Referring now to FIGS. 1 and 2, there is shown a washing apparatus 10, configured in accordance with the principles of the present invention; wherein the washing apparatus comprises a chamber 11 defined within a housing 12 having a support surface 14 in the form of an aperatured plate. The support surface 14 has a rectangular opening 15 which has a deflector plate 16 therein with a gasket 17 attached thereto to form a seal with a rectangular assay plate 18 (FIGS. 12-15) when the assay plate is mounted therein. As is seen in FIG. 2 the assay plate 18, shown in dotted lines, is mounted in the rectangular opening 15 by being positioned beneath a plate cover 19 so as to be disposed between the plate cover and the gasket 17 shown in FIG. 1.

Figure 3:
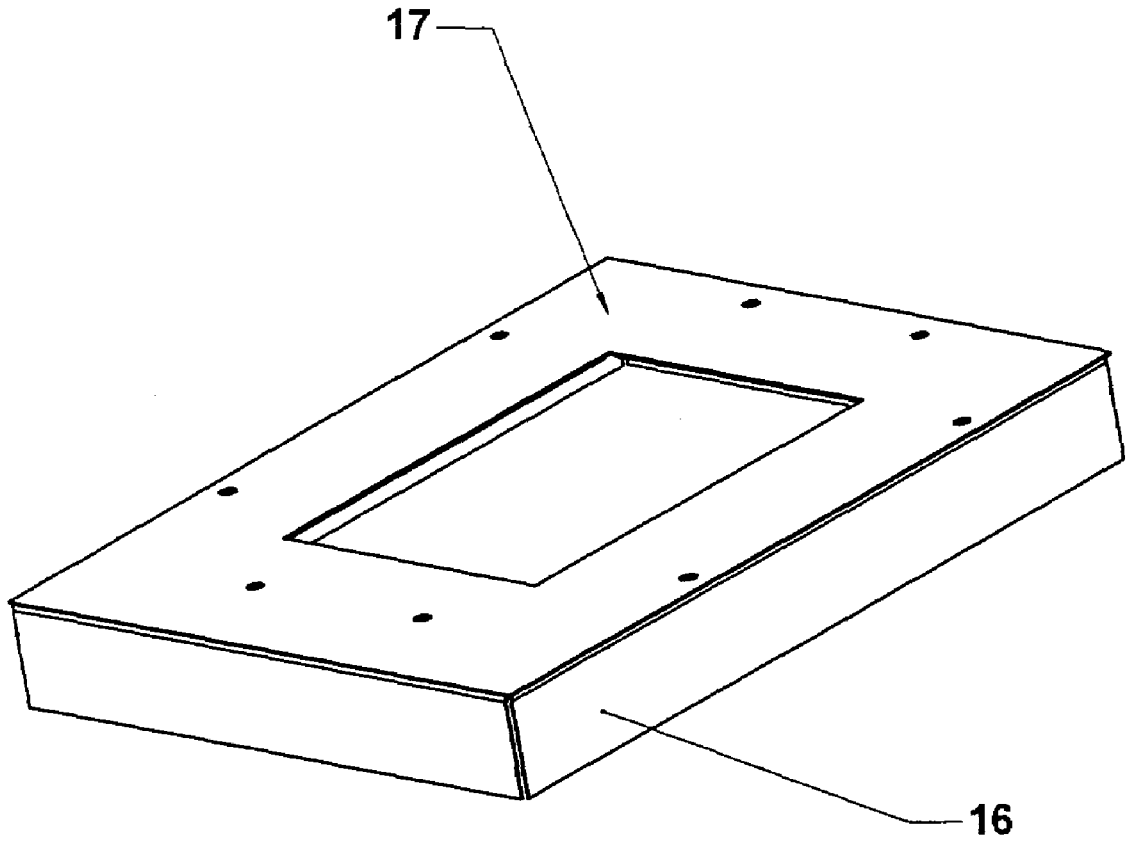
FIG. 3 is a perspective view of a deflector plate with a gasket on which an assay plate is positioned face down.
Figure 4:
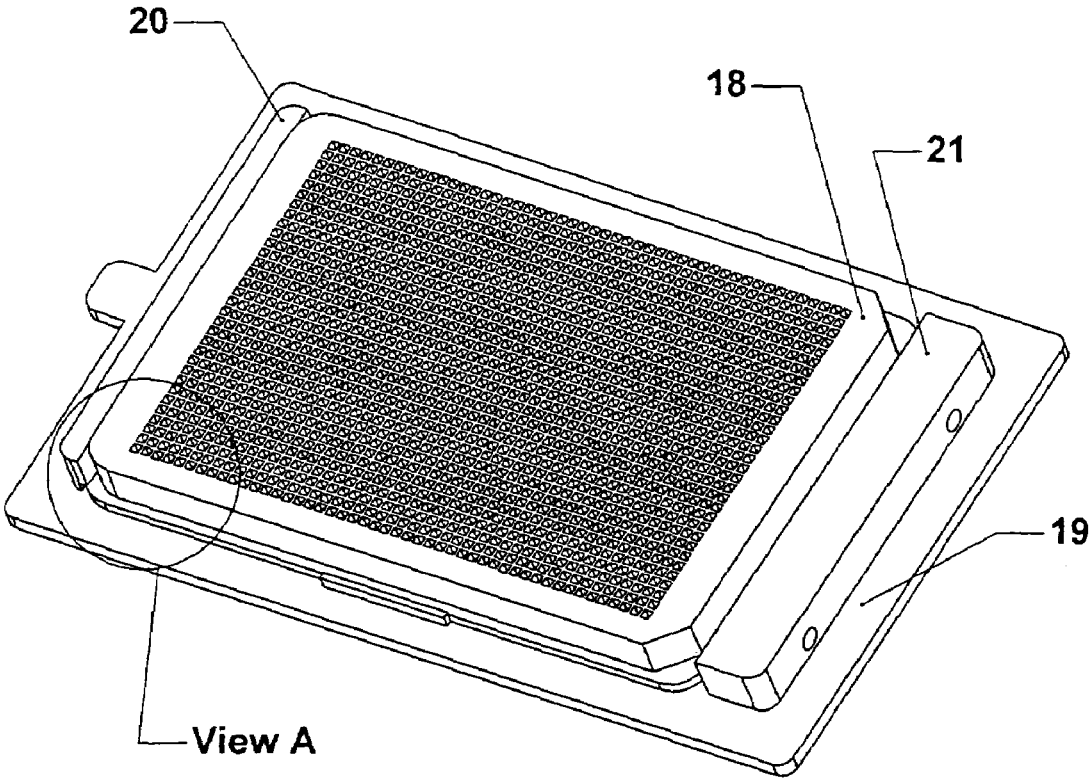
FIG. 4 is a perspective view of an assay plate cover for holding the assay plate when the assay plate is placed on the washing apparatus.
Figure 4:
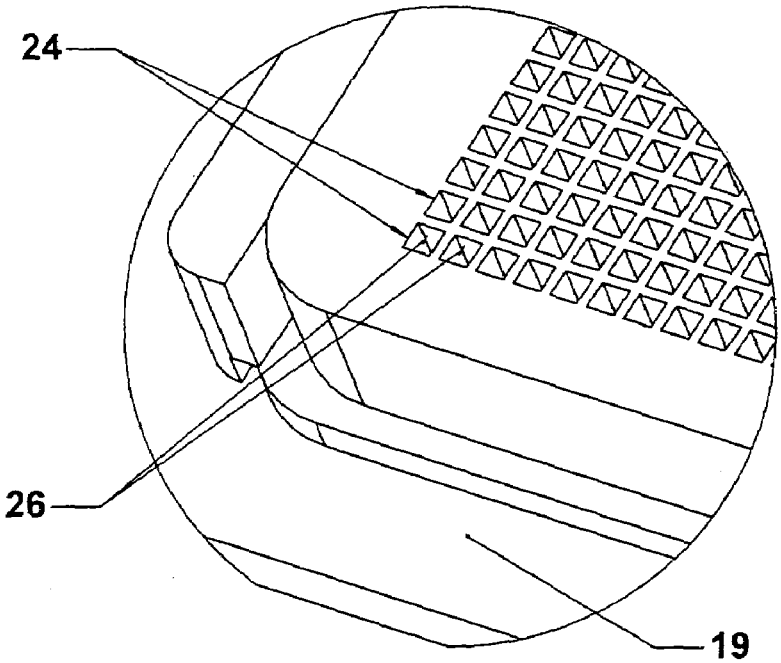

Referring now to FIGS. 3 and 4, the assay plate 18 (FIGS. 11-14) is initially placed on the plate cover 19 face up in FIG. 4, between positioning stops 20 and 21. This is done manually or automatically. The plate cover 19 with the assay plate 18 thereon is then turned over and placed face down in the opening 15 shown in FIG. 1 against the gasket 17 on the deflector 16, so as to be supported in the washing apparatus 10 against a seal as is shown in FIG. 2. This can be done manually or automatically with an automated plate rotator.

Figure 5:
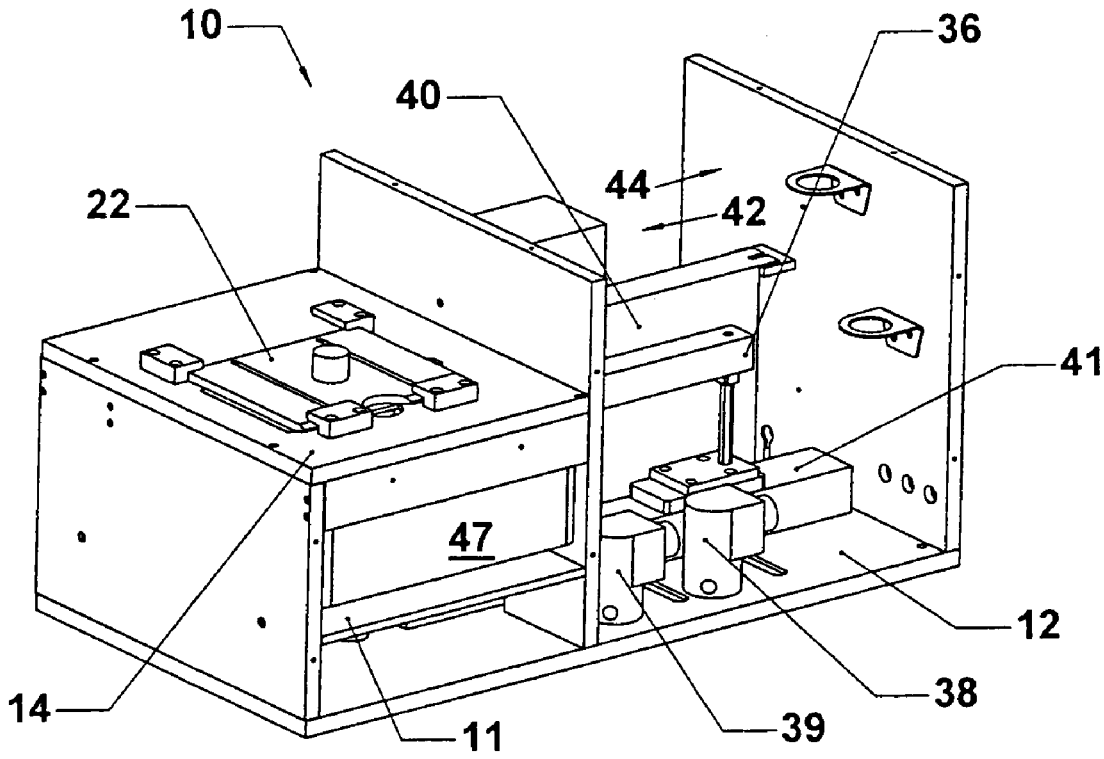
FIG. 5 is a view similar to FIGS. 1 and 2, but showing a slider overlying the assay plate cover.

After the assay plate 18 and plate cover 19 are mounted as shown in FIG. 2, a slide plate 22 is moved over the assay plate cover 19 to hold the assay plate cover down and to add pressure forcing the assay plate 18 to seat snugly against the gasket 17 as is shown in FIG. 5. The procedure for mounting the assay plate 18 is performed either manually or automatically. If automated, the assay plate 18 is inserted onto the assay plate cover 19 by a robotic hand or by a stacker system, after which the assay plate cover 19 is inverted automatically for mounting in the rectangular opening 15. Automating this system is within the skill of one knowledgeable in the field of automating machinery.

Figure 6:
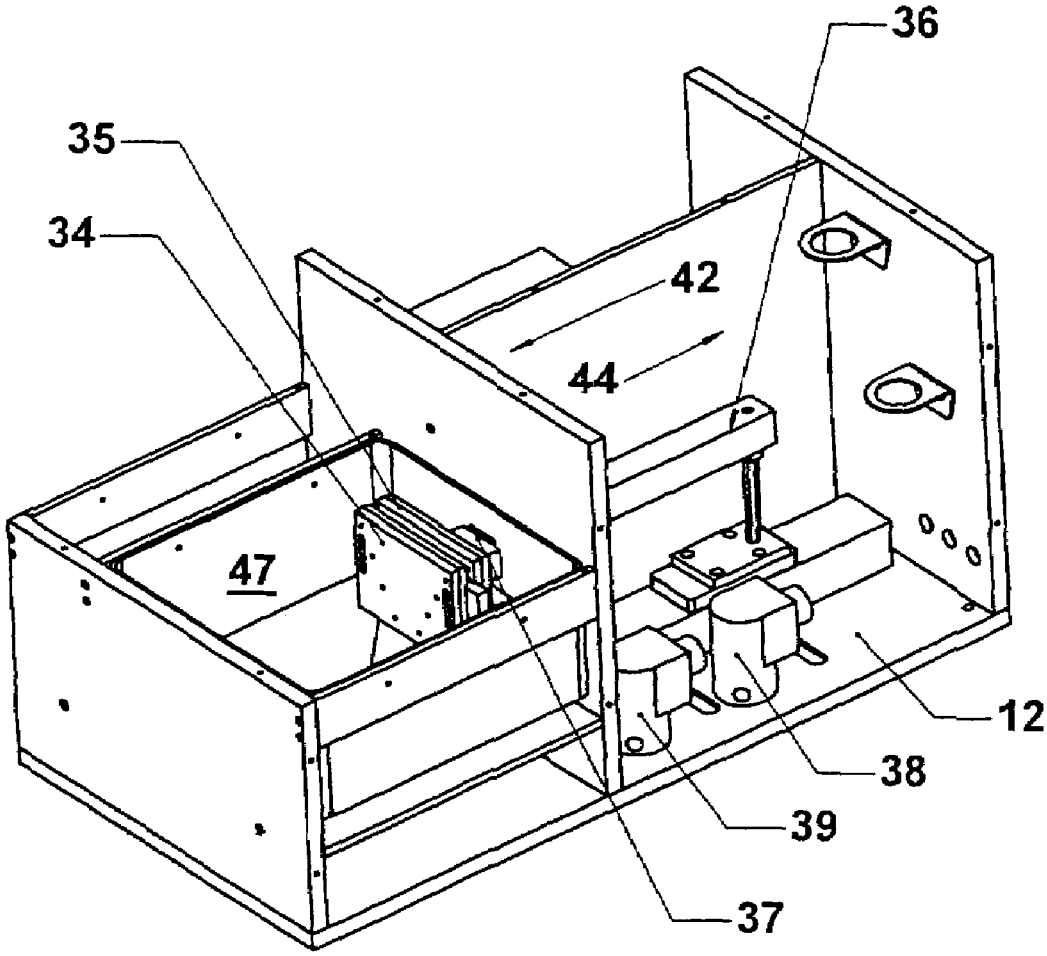
FIG. 6 is a view similar to FIGS. 1, 2 and 5, but showing a support surface of the washer apparatus removed.

After the assay plate 18 is mounted in the rectangular opening 15 in the support surface 14 as seen in FIG. 5, discrete or indiscrete deposit sites 24(FIGS. 4 and 12-15) are washed by one or more nozzles 34 mounted on a support bar 36 (as is seen in FIG. 6 with the support surface 14 removed). In accordance with one arrangement, the sites 24 are configured as wells each with an opening 26 (see FIGS. 4 and 12-15). In the illustrated embodiment, one nozzle 34 is used for washing and another nozzle 35 is used for drying. The support bar 36 is hollow and receives fluid tubes therethrough to connect the nozzles 34 and 35 to fluid control valves 38 and 39, respectively. Preferably, the support bar 36 is controlled by a robotic controller 40 that operates a linear drive 41 to move the support bar 36 in a programmable manner for both direction and speed. More specifically, the robotic controller 40 causes the linear drive 41 to advance the support bar 36 longitudinally in the direction of arrow 42 and retracts the support bar longitudinally in the direction of arrow 44. The robotic controller 40 also controls the closing and opening of the fluid control valves 38 and 39 used for controlling the flow of washing liquid and air to the nozzles 34 and 35.

Figure 7:
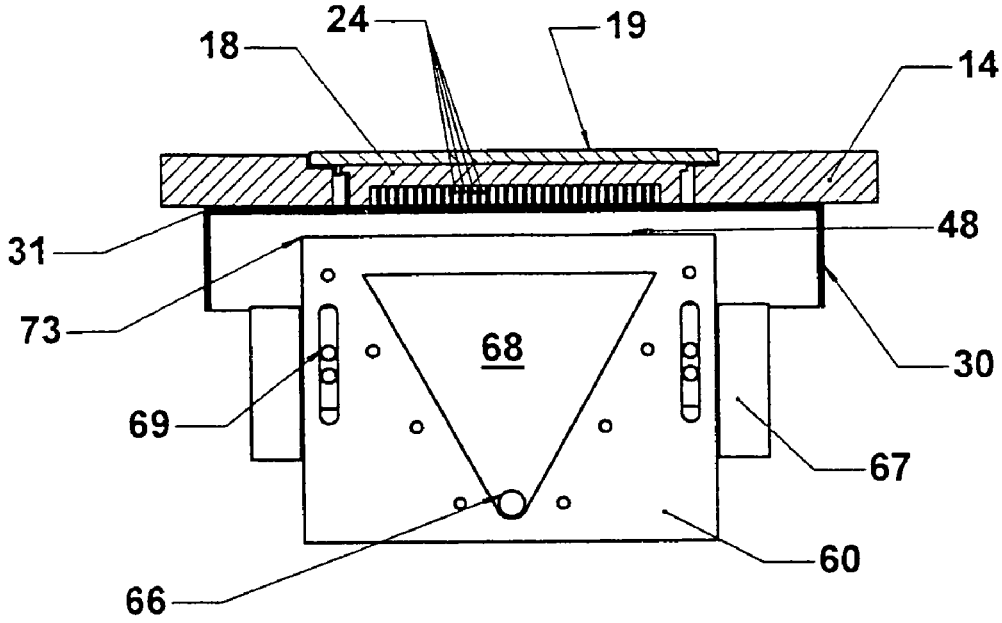
FIG. 7 is an end elevation of a portion of the washer apparatus of FIGS. 1-6 and 2.
Figure 8:
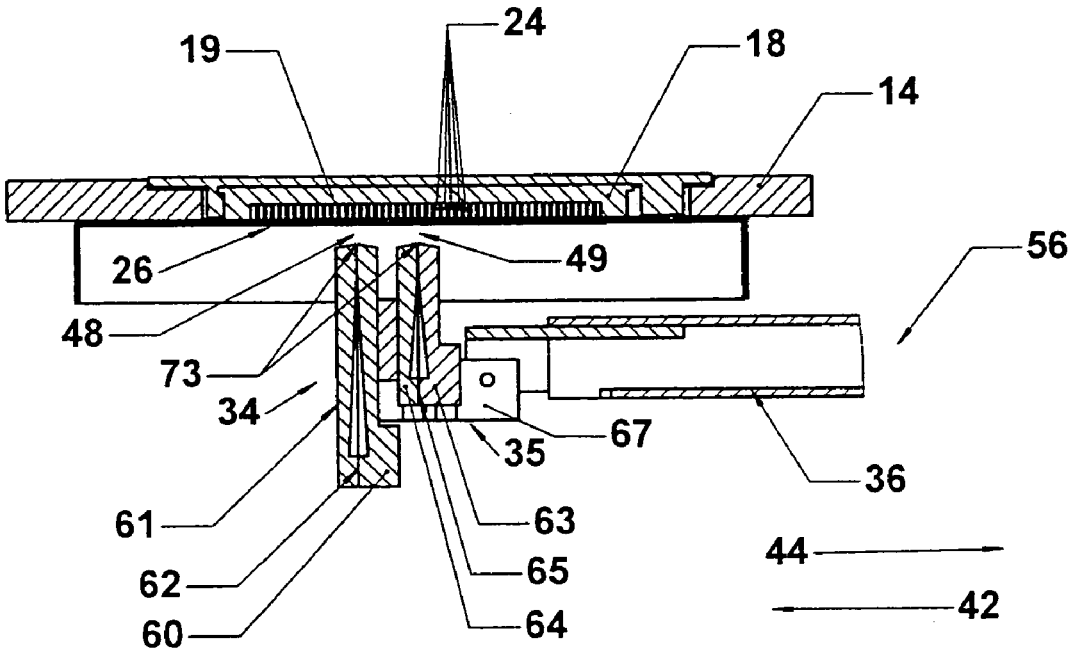
FIG. 8 is a side elevation of the portion of the washer apparatus of FIGS. 1-6.

Considering now FIGS. 7 and 8 in combination with FIGS. 1-6, the support bar 36 is moved first in the direction of arrow 42 while washing liquid under pressure flows through the support bar 36 to the nozzle 34 from which it is sprayed upwardly to wash the sites 24 of the plate 18. The washing liquid falls by gravity from each of the sites 24 into a tub 47 (FIGS. 1 and 2) in the chamber 11, and if the sites are wells, the washing fluid falls without contaminating adjacent sites with used washing liquid. This is because the spent washing liquid falls away into the tub and does not flow into adjacent sites 24 if the sites are configured as wells. Even if the sites 24 are deposit sites, the washing liquid tends to drop vertically away from the sites, tending to minimize cross contamination. After the assay plate 18 is washed, the motion of the support bar 36 is reversed to move in the direction of the arrow 44. While the support bar 36 is moving in the direction of arrow 44, the sites 24 may be dried by a stream of gas or air from the nozzle 35, which stream is directed upwardly and impinges on the sites 24 to displace and evaporate remaining washing liquid. While the drying step can occur as the support bar 36 moves in the direction of arrow 44, it is also contemplated that the drying step could occur while the support bar 36 is moving in the direction of arrow 42. Preferably, the nozzle 34 dispenses the washing liquid in the configuration of a sheet 48 and the nozzle 35 dispenses drying air as a sheet 49, which sheets are perpendicular to and extend laterally with respect to the axis 56 of the spray bar 36. While single nozzles 34 and 35 are shown, more than one nozzle 34 and one nozzle 35 may be employed.

Figure 9:
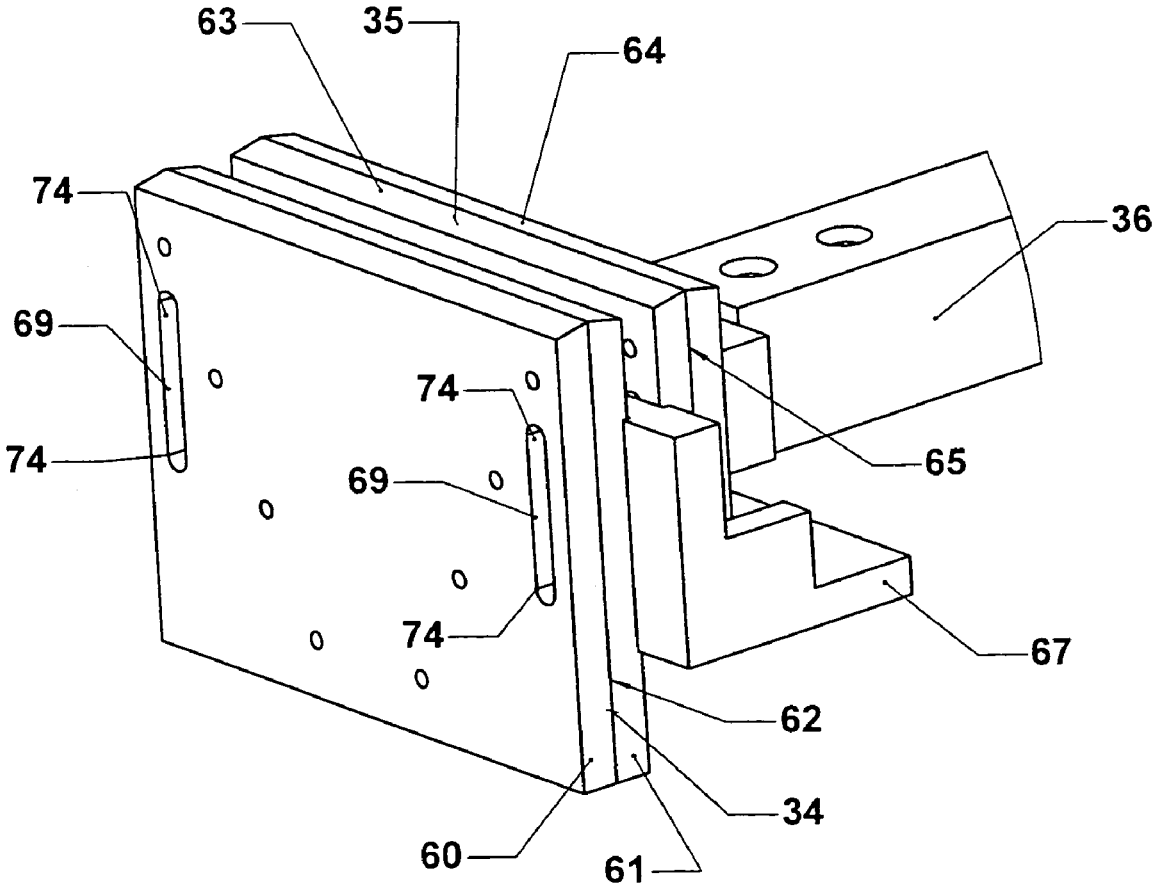
FIG. 9 is a perspective view showing nozzles mounted on a nozzle plate and spray bar.
Figure 10:
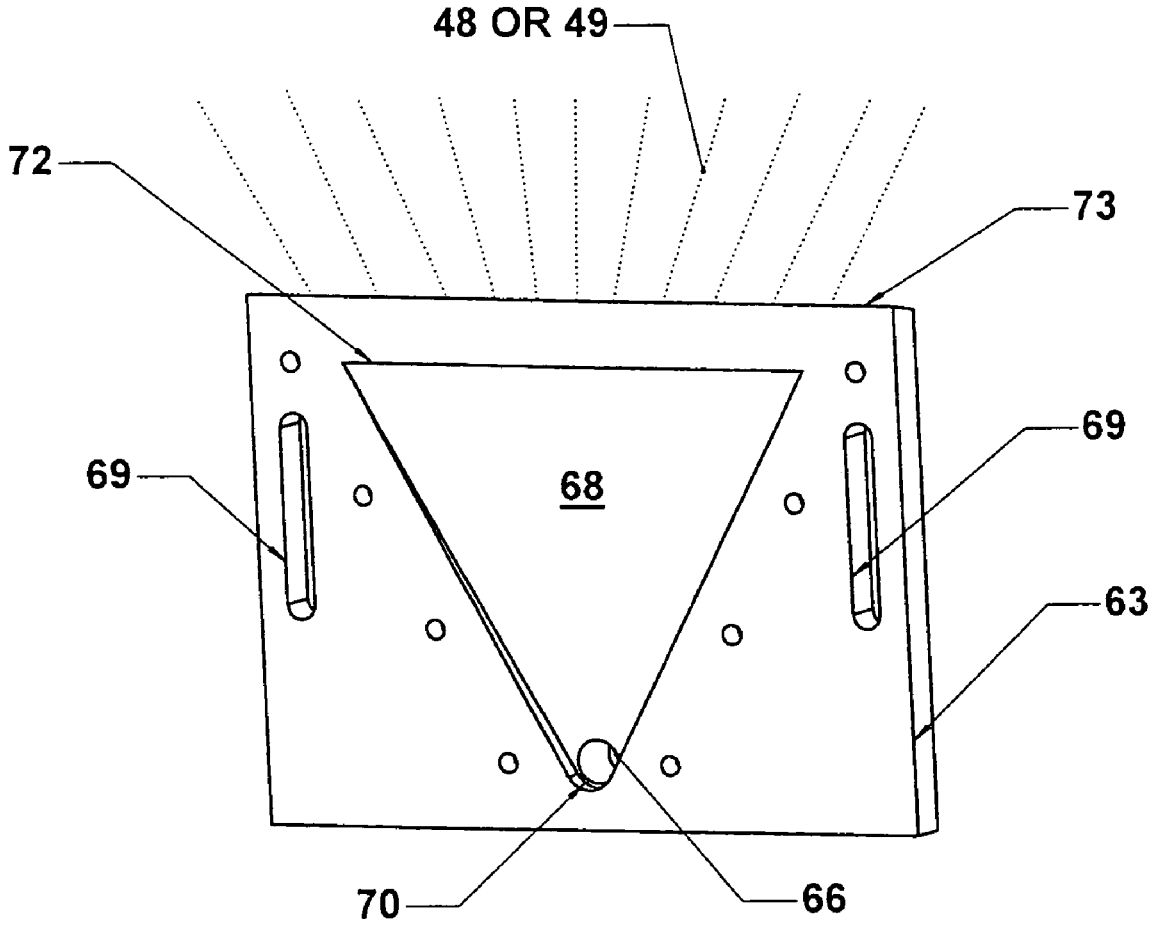
FIG. 10 is a perspective view of half of one of the nozzles.

As is seen in FIGS. 9 and 10, each of the nozzles 34 and 35 are configured with two plates with a gap shim therebetween. Nozzle 34 is comprised of nozzle plates 60 and 61 and shim 62, while nozzle 35 is comprised of nozzle plates 63 and 64 and shim 65. At least one plate of each nozzle has an inlet port 66 therein which communicates with a triangular space 68. The triangular space 68 is defined by an apex 70 at the inlet port 66 and a base line 72 at outlet slot 73 when the nozzle plates 60 and 61 and nozzle plates 63 and 64, respectively are sandwiched together. Shims 62 and 65 (FIG. 9) create nozzle orifices defined by slots 73 that may be different between nozzles 34 and 35 to give the optimum space needed for dispensing liquid or air.

Each of the nozzles 34 and 35 are mounted on a nozzle plate 67 and is adjustable vertically on screws 74 extending through mounting slots 69 in the nozzles. The gaps generated by shims 62 and 65 form the slots 73 so that washing liquid and drying gases are dispensed in the form of the sheets 48 and 49, respectively, which sheets define knife edges. Consequently, as the spray bar 36 moves in the direction of arrow 42 (FIG. 8), the sheet 48 of liquid which spreads longitudinally with respect to the axis 56 of the spray bar 36 sequentially washes rows of sites 24. Subsequently, as the spray bar 36 moves back in the direction of arrow 44 (FIG. 8), the sheet 49 of gases also moves longitudinally with respect to the axis 56 of the spray bar 36, sequentially drying rows of sites 24. In another embodiment, the drying sequence may be initiated after the spray bar 36 has moved in the direction of arrow 44 and returned back to the position from which the washing sequence began.

In the illustrated embodiment, two nozzles 34 and 35 are shown. If it is decided to dispense washing liquid and drying air or gas from the same nozzle 34 then only one nozzle 34 may be needed, but if it is desired to dispense washing liquid from one nozzle and drying gas from another, then at least two nozzles are needed, one for dispensing washing liquid and the other for dispensing air or gas.

In the illustrated embodiment, the assay plate 18 is held stationary while the nozzles 34 and 35 are reciprocated with the spray bar 36. It is also within the scope of this invention to hold the nozzles 34 and 35 stationary and reciprocate the support surface 14 holding the assay plate 18. While only a single assay plate 18 is illustrated as being washed and dried at one time, it is also an option to wash two or more assay plates 18 simultaneously by, for example, having wider sheets 48 and 49 of washing liquid and drying gas. On the other hand, if the assay plates 18 are aligned in the direction of motion of support bar 36, then a plurality of assay plates may be washed and dried sequentially without laterally shifting the spray bar 36. Multiple washing and drying heads 34 and 35 may also be used if there are a plurality of assay plates 18.

While directing a stream of air or other gas through the nozzle 35 to dry the sites 24 in a assay plate 18 is preferred, the sites also may be dried by being aspirated with a vacuum applied to the nozzle 35. In other approaches, the chamber 11 defined by the frame 14 may be aspirated by applying a vacuum thereto, or liquid may be evaporated by applying gentle heat to the plate 18 of a temperature lower than that which could adversely affect the deposits at the sites 24. In another approach the wells could be washed with a liquid drying agent, such as methanol, which would then be allowed to evaporate.

Figure 11:
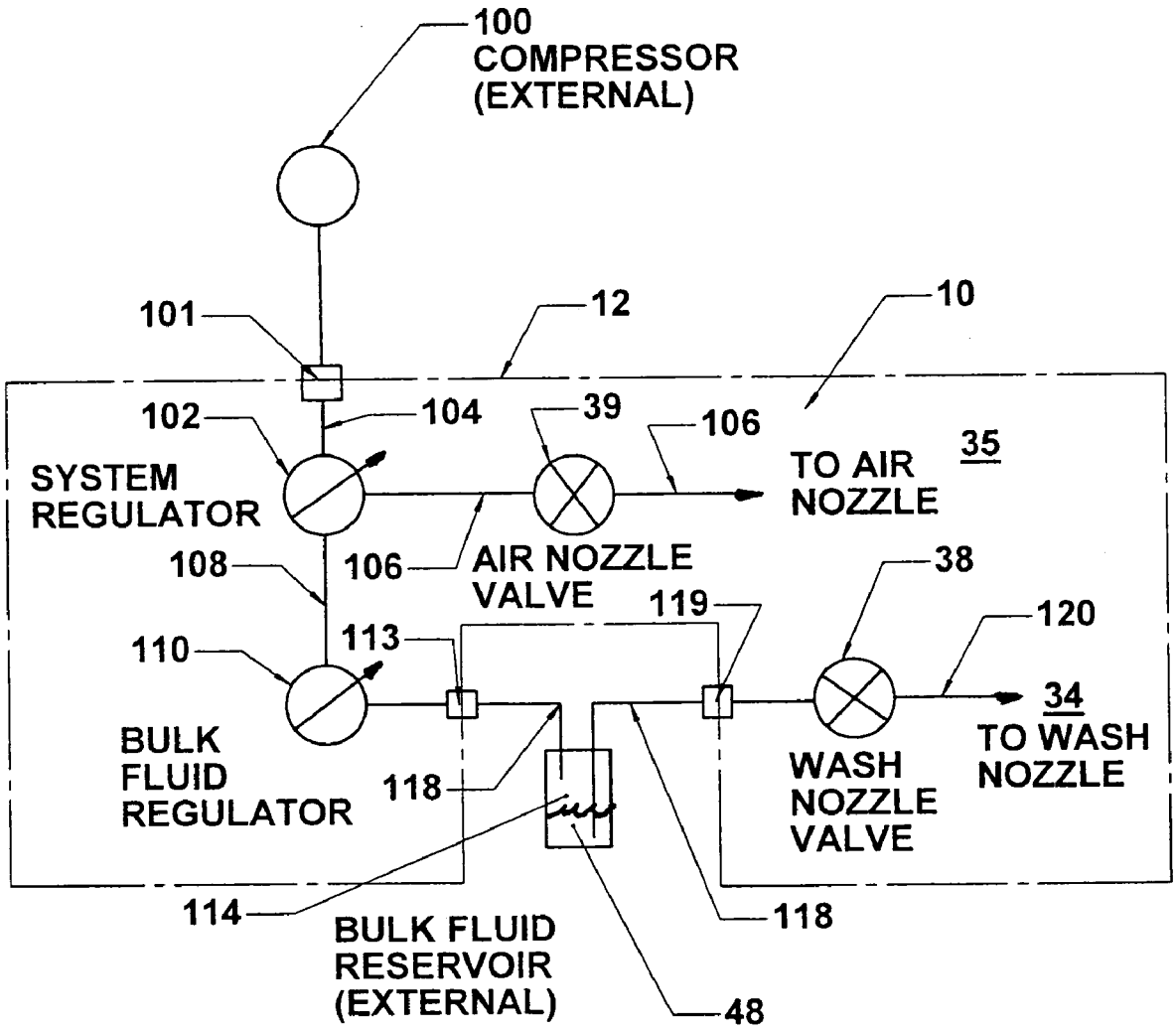
FIG. 11 is a block diagram of a system for delivering washing liquid and air to the nozzles shown in FIG. 9.

Referring now to FIG. 11 there is shown a block diagram of a system for delivering washing liquid 48 and drying air 49 (see FIGS. 7 and 8) to nozzles 34 and 35, respectively. The system comprises an air compressor 100, preferably disposed outside of the housing 12 containing the washing apparatus 10. The air compressor 100 is connected through an opening 101 in the housing 12 to a system regulator 102 by a main compressed air line 104. The system regulator 102 is connected to the air nozzle valve 39 (FIGS. 1, 2, 5 and 6) by a first compressed air line 106. The air nozzle valve 39 supplies compressed air to the air nozzle 35 of FIGS. 8-10. A second compressed air line 108 from the system regulator 102 is connected to a bulk air regulator 110. The bulk air regulator 110 has a compressed air line 112 connected through an opening 113 in the housing 12 to the head space 114 of a bulk fluid reservoir 115 that is positioned externally of the washing apparatus 10. A dip tube 118 in the washing fluid 48 is connected through an opening in the housing 119 to the wash nozzle valve 38 (FIGS. 1, 2, 5 and 6) that in turn is connected by a line 120 to deliver washing liquid 48 under pressure to wash the nozzle 34. Accordingly, the air compressor 100 pressurizes the washing liquid 48 dispensed through the wash nozzle 34, as well as supplying drying air to the air nozzle 35. The washing liquid 48 may be any suitable washing liquid, such as but not limited to, PBS plus 0.10% Tween 80.

Figure 12:
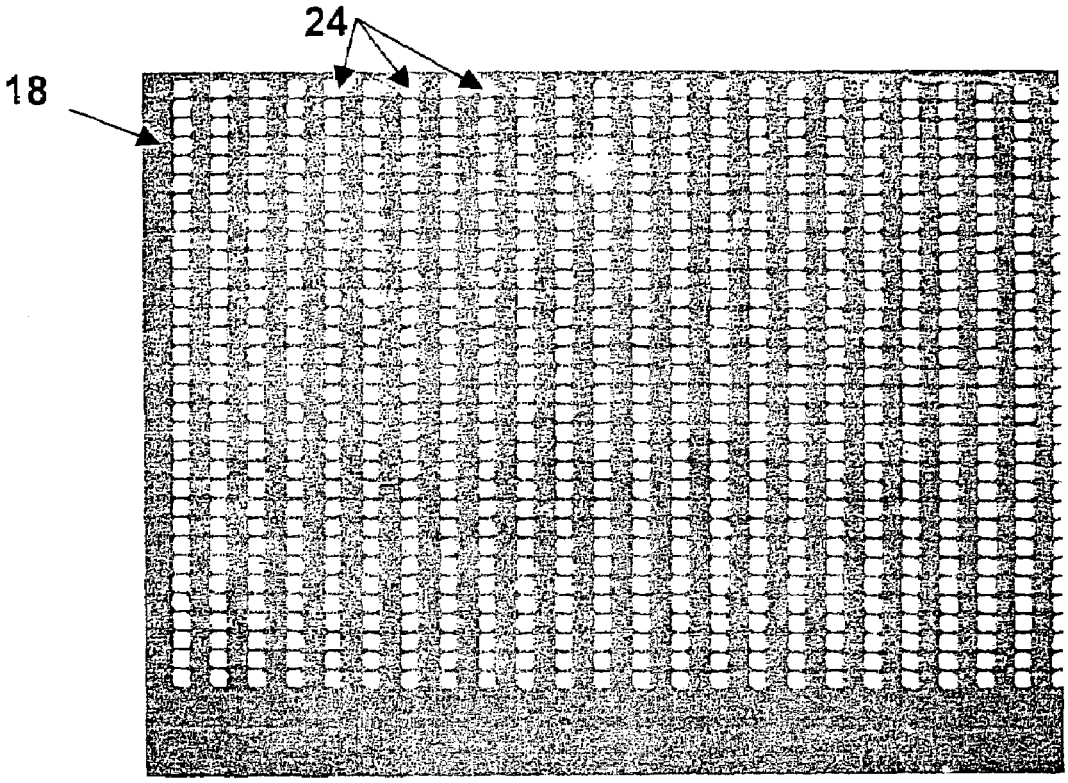
FIG. 12 is a photograph showing a Greiner well plate with 1536 wells having 8 μl Cy5 labeled rabbit IgG added to every other column in the plate.

Referring now to FIG. 12 there are shown sites 24, configured as wells, in an uncoated assay plate from Greine, Inc. 18 with Cy5 labeled rabbit IgG obtained from BioMedTech Laboratories, Inc added to the sites 24 of every other column. The image was taken with a 50 second exposure using a Tundra Imaging Camera (Imaging Research, Inc.) with filters for Cy5.

Figure 13:
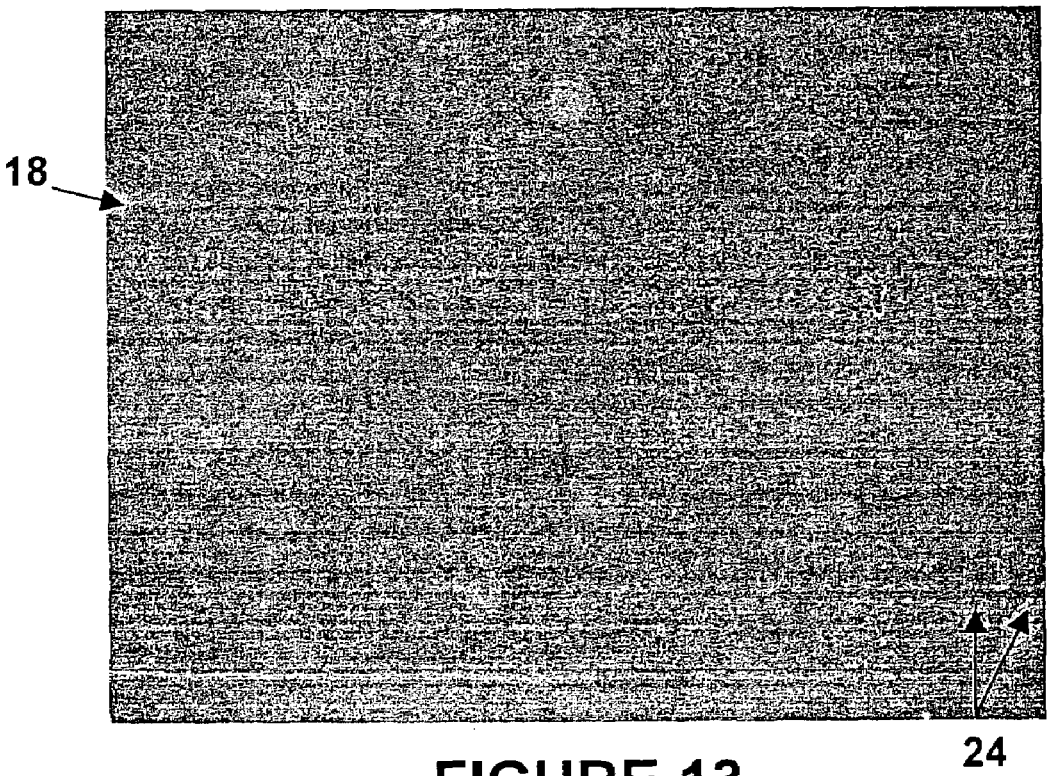
FIG. 13 is a photograph showing the well plate of FIG. 12 after washing.

Referring now to FIG. 13 there is shown a 50 second exposure after washing the sites 24 of FIG. 12 with the washing apparatus described in the specification. This shows that washing removes the labeled material added in FIG. 12

Figure 14:
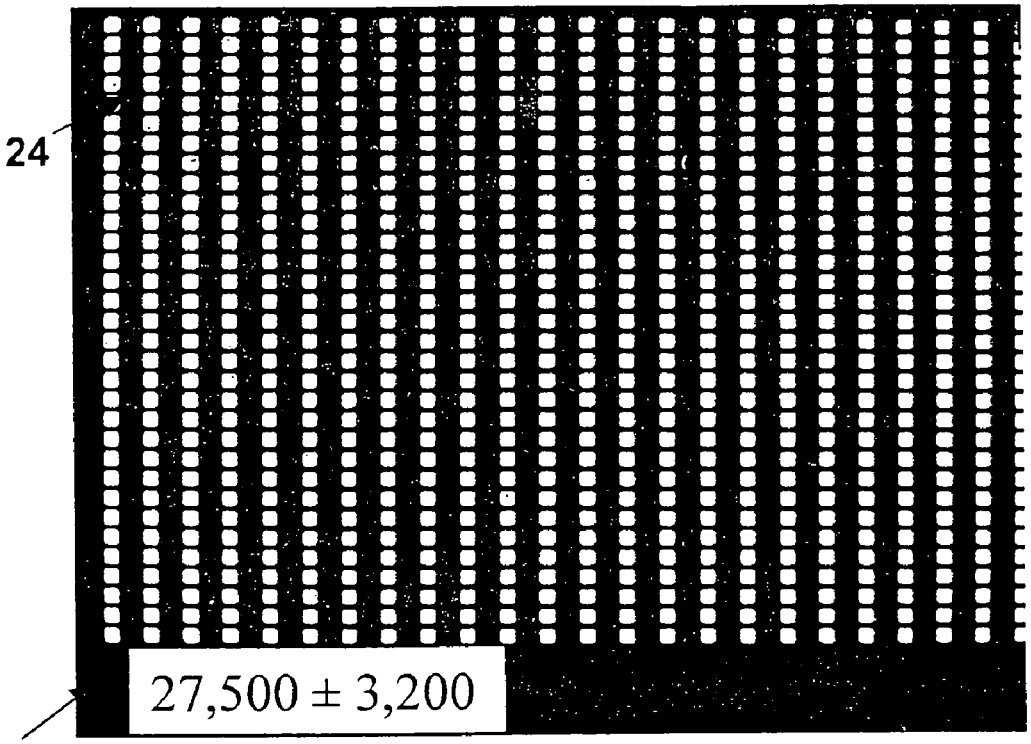
FIG. 14 is a photograph showing a Greiner well plate with 1536 wells having goat anti-rabbit IgG attached with 8 ul Cy5 labeled rabbit IgG added to every other column.

Referring now to FIG. 14 there is shown a Greiner 1536 well microplate that has Goat anti-rabbit IgG bonded tightly to the surface of each of the sites 24 configured as wells in the assay plate 18. The assay plates 18, obtained from BioMedTech Laboratories, Inc., have 8 μl rabbit IgG labeled with Cy5 added to sites 24 of every other column, and incubated for 3 hours at room temperature under humidified conditions. The exposure was taken for 50 seconds. The intensity was 27,500+/−3,200.

Figure 15:
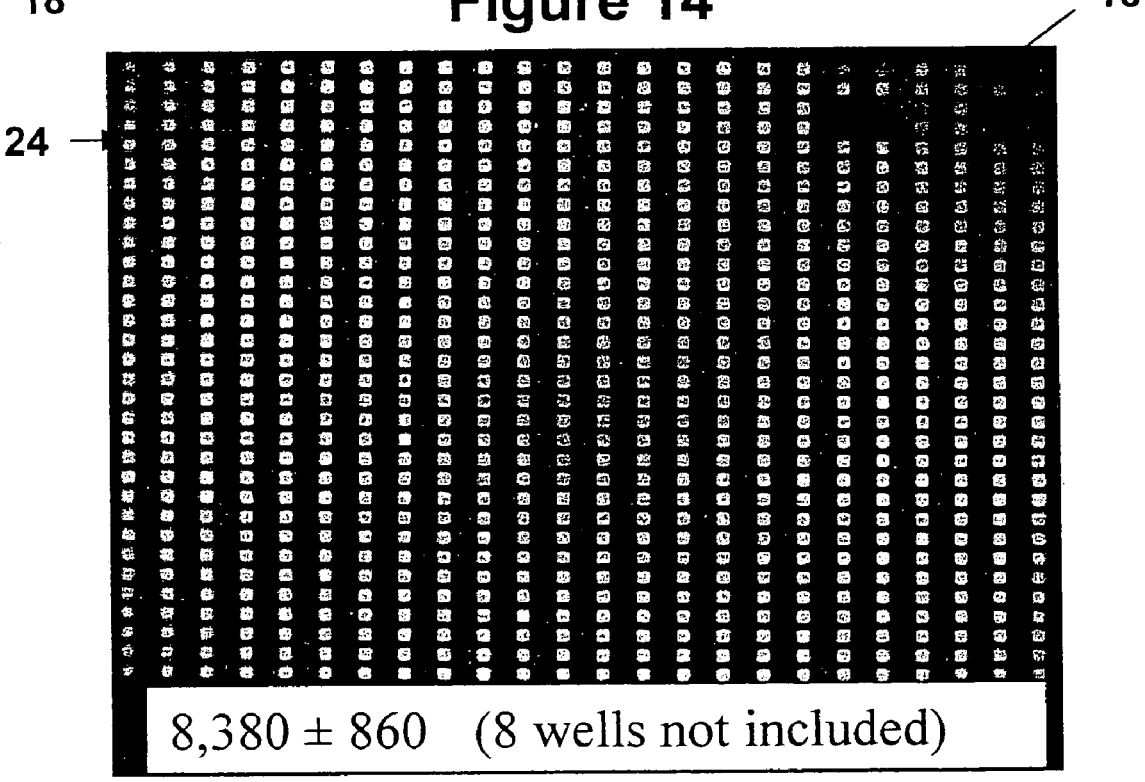
FIG. 15 is a photograph showing the well plate of FIG. 14, a well plate washed with PBS plus 0.1% Tween 80 and which demonstrates no cross-over contamination.

Referring now to FIG. 15, the well plate array of FIG. 14 is shown after washing. The intensity measurements of the sites 24 configured as wells that received the Cy5 labeled rabbit IgG were 8,380+/−860. The empty sites 24 configured as wells adjacent to the sites receiving the Cy5 labeled rabbit IgG had background signals. This demonstrates that the washer works well with no detectable crossover contamination, i.e., no signal was seen in the neighboring wells 24 that had not received Cy5 labeled rabbit IgG.

Without further elaboration, it is believed that one skilled in the art can, using the preceding description, utilize the present invention to its fullest extent. The following preferred specific embodiments are, therefore, to be construed as merely illustrative, and not limitative of other portions of the disclosure in any way whatsoever.

In the foregoing and in the following examples, all temperatures are set forth uncorrected in degrees Celsius and, all parts and percentages are by weight, unless otherwise indicated.

EXAMPLE

FIG. 12 shows a Greiner micro well plate 18 with 1536 sites 24 configured as wells loaded with 8 μl rabbit IgG labeled with Cy5 in all the sites of every other column. The image of FIG. 12 was collected for 50 seconds with a Tundra imager. The plate was then washed three times with the washer and as seen in FIG. 13, another image recorded for 50 seconds. As is seen in the photograph, no fluorescence was detected after washing.

The Greiner microplates of FIG. 14 were obtained from BioMedTech Laboratories, Inc. Samples (8 μl) of the IgG were pipetted into every other column, and the IgG was allowed to bind to the anti-IgG on the surface for 3 to 5 hours. Column 1 had buffer alone. FIG. 14 shows the amount of Cy5 labeled rabbit IgG added to sites 24 configured as wells in the plate 18. This plate had Goat anti-rabbit IgG bound tightly to the surface of all but 7 of the 1536 sites 24. This picture was taken after addition of the rabbit IgG and before washing. After the image was taken, the well plate was washed three times with the washer and imaged as above. This image is seen in FIG. 15. Roughly 30% of the IgG that had been added to each well 24 remained specifically bound. Several sites 24 in the right hand corner of the picture did not have goat anti-rabbit IgG bound to the surface, and accordingly these sites were washed completely of all (unbound) IgG. The data also shows that cross-over contamination did not occur because wells not receiving labeled IgG lacked any detectable fluorescence. Reproducibility (CV) before the wash was 11.6% and after the wash was 10.3%.

The data shows that the washer of this invention performs well for high density (1536-well) well plates. There was no clogging observed and non-specific fluorescence was completely flushed away. Specific binding was easily and reproducibly detected in plates that had Goat anti-rabbit IgG attached.

The entire disclosures of all applications, patents and publications, cited herein are incorporated in their entirety by reference herein.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

What is claimed is:

1. In combination:

at least one assay plate, the assay plate having rows of individual wells, the wells being defined by open top areas normally opening upward and indented closed surfaces, upon which indented closed surfaces biochemical deposits are attached, an apparatus for washing unattached biochemical material from the indented closed surfaces of the individual wells in the assay plate, the combination comprising:

a support for mounting the assay plate inverted with the open top areas of the wells facing downwardly, a spray arrangement for washing the rows of wells, the spray arrangement being positioned beneath the support, the spray arrangement having a single nozzle oriented for directing washing liquid upwardly when the assay plate is mounted on the support, the single nozzle having an outlet configured as a slit to spray washing liquid therefrom as a sheet up onto the assay plate to wash simultaneously unattached biochemical materials sequentially from rows of wells aligned with the sheet of liquid, whereby the washing fluid drains downwardly from each well minimizing cross contamination of wells while leaving attached biochemical materials in the wells and carrying away unattached material, the single nozzle and assay plate being mounted for motion with respect to one another in a direction transverse to the rows of wells aligned with the sheet to wash sequentially successive rows of wells.

2. The combination of claim 1 wherein the wells have widths of a selected dimension and wherein the slit has a width selected to generate a thickness of the sheet of liquid, the thickness being of a dimension less than the widths of the wells.

3. The combination of claim 2 wherein the apparatus includes a drying arrangement for drying the wells after washing the wells.

4. The combination of claim 3 wherein the drying arrangement comprises a separate nozzle beneath the assay plate for dispensing drying gas or air upwardly toward the assay plate and into the wells.

5. The combination of claim 4 wherein the separate nozzle has a slit for dispensing the drying gas or air as a sheet with an edge to thereby dry sequentially rows of wells aligned with the sheet, the separate nozzle and assay plate being mounted for relative motion with respect to one another in a direction transverse to the aligned wells.

6. The combination of claim 5 wherein the assay plate and nozzles are mounted for relative motion only in a direction transverse to one another.

7. The combination of claim 1 wherein the apparatus includes a drying affangement for drying the wells after washing the wells.

8. The combination of claim 7 wherein the drying arrangement comprises a separate nozzle dispensing drying gas or air upwardly toward the assay plate and into the wells.

9. The combination of claim 8 wherein the separate nozzle has a slit for dispensing the drying gas or air as a sheet with an edge to thereby dry sequentially rows of wells aligned with the sheet, the separate nozzle and assay plate being mounted for relative motion with respect to one another in a direction transverse to the aligned wells.

10. The combination of claim 9 wherein the assay plate and nozzles are mounted for relative motion only in a direction transverse to one another.

* * * * *